US005855429A

United States Patent [19]

Webb, Jr. et al.

[11] Patent Number: 5,855,429

[45] Date of Patent: Jan. 5, 1999

[54] SAFETY LIGHT

[76] Inventors: David H. Webb, Jr., 9030 Gladys, White Lake, Mich. 48386; Robert E. Webb, 1715 W. Troy, Ferndale, Mich. 48220

[21] Appl. No.: 933,429

[22] Filed: Sep. 18, 1997

[51] Int. Cl.[6] ..... F21V 21/08

[52] U.S. Cl. ..... 362/396; 362/104; 362/124; 362/191; 362/806

[58] Field of Search ..... 362/103, 104, 362/105, 106, 108, 124, 806, 808, 396, 191

[56] References Cited

U.S. PATENT DOCUMENTS 2,814,158 11/1957 Gelardin ..... 362/104
3,805,047 4/1974 Dockstader ..... 362/104
5,239,450 8/1993 Wall ..... 362/104
5,327,588 7/1994 Garneau ..... 362/105

*Primary Examiner*—Stephen F. Husar

[57] ABSTRACT

A safety light is provided including a housing having a front face, a rear face, and a periphery formed therebetween defining an interior space. The rear face having a recess formed therein. A pin and clasp assembly is coupled within the recess of the housing and adapted to releasably attach the housing to a first recipient surface. A pile type fastener is adhered to the rear face of the housing and surrounds the rectangular recess. The pile type fastener is adapted to releasably attach the housing to a second recipient surface. Also included is a light emitting diode connected to the housing and adapted to illuminate upon the receipt of power. Finally, a switch is connected between the light emitting diode and a battery for allowing the transmission of power to the light emitting diode upon the closing thereof.

4 Claims, 2 Drawing Sheets

SAFETY LIGHT

BACKGROUND OF THE INVENTION

1. Field of the Invention

The present invention relates to head gear mounted flashlights and more particularly pertains to a new safety light for indicating the current location of a child, snowmobile rider, hunter, or the like.

2. Description of the Prior Art

The use of head gear mounted flashlights is known in the prior art. More specifically, head gear mounted flashlights heretofore devised and utilized are known to consist basically of familiar, expected and obvious structural configurations, notwithstanding the myriad of designs encompassed by the crowded prior art which have been developed for the fulfillment of countless objectives and requirements.

Known prior art head gear mounted flashlights include U.S. Pat. No. 4,186,429; U.S. Pat. Des. 318,338; U.S. Pat. No. 4,817,212; U.S. Pat. No. 4,231,079; U.S. Pat. No. 5,159,720.

In these respects, the safety light according to the present invention substantially departs from the conventional concepts and designs of the prior art, and in so doing provides an apparatus primarily developed for the purpose of indicating the current location of a child, snowmobile rider, hunter, or the like.

SUMMARY OF THE INVENTION

In view of the foregoing disadvantages inherent in the known types of head gear mounted flashlights now present in the prior art, the present invention provides a new safety light construction wherein the same can be utilized for indicating the current location of a child, snowmobile rider, hunter, or the like.

The general purpose of the present invention, which will be described subsequently in greater detail, is to provide a new safety light apparatus and method which has many of the advantages of the head gear mounted flashlights mentioned heretofore and many novel features that result in a new safety light which is not anticipated, rendered obvious, suggested, or even implied by any of the prior art head gear mounted flashlights, either alone or in any combination thereof.

To attain this, the present invention generally comprises a housing with a generally rectilinear configuration having a translucent front face, an opaque rear face, and a periphery formed therebetween defining an interior space. As shown in FIG. 4*a*, the rear face has a rectangular recess formed therein. The front face of the housing is tinted a yellow color. With continuing reference to FIG. 4*a*, a pin and clasp assembly is coupled within the recess of the housing. The pin of the assembly is adapted for pivoting between a stored orientation with the pin residing within a plane defined by the rear face of the housing and an extended orientation with the pin residing within a plane residing in perpendicular relationship with the rear face of the housing and extending outwardly from the recess. The pin and clasp assembly is adapted to releasably attach the housing to a first recipient surface. Such is accomplished by removing the pin from the clasp, attaching the pin to the recipient surface, and subsequently engaging the pin with the clasp. With reference now to FIG. 4*b*, a pile type fastener is adhered to the rear face of the housing and surrounds the rectangular recess. The pile type fastener serves to releasably attach the housing to a second recipient surface. As shown in FIGS. 1 & 3, a light emitting diode is provided. Such diode is situated within the interior space of the housing adjacent the front face thereof. In use, the light emitting diode functions to illuminate upon the receipt of power. Associated therewith is a switch situated on the periphery of the housing and connected between the light emitting diode and a battery. The switch allows the transmission of power to the light emitting diode only upon the manual closing thereof. FIG. 1 shows a flashing means situated within the interior space of the housing and connected between the switch and the light emitting diode. Upon the receipt of power, the flashing means effects the intermittent transfer of such power from the battery to the light emitting diode thereby effecting the flashing of light. Finally, a plurality of figures are provided. Note FIGS. 5*a* & 5*b*. Each figure includes a rectilinear cut out formed therein for removably receiving the housing such that the front face is visible and the rear face is accessible. There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new safety light apparatus and method which has many of the advantages of the head gear mounted flashlights mentioned heretofore and many novel features that result in a new safety light which is not anticipated, rendered obvious, suggested, or even implied by any of the prior art head gear mounted flashlights, either alone or in any combination thereof.

It is another object of the present invention to provide a new safety light which may be easily and efficiently manufactured and marketed.

It is a further object of the present invention to provide a new safety light which is of a durable and reliable construction.

An even further object of the present invention is to provide a new safety light which is susceptible of a low cost of manufacture with regard to both materials and labor, and which accordingly is then susceptible of low prices of sale to the consuming public, thereby making such safety light economically available to the buying public.

Still yet another object of the present invention is to provide a new safety light which provides in the apparatuses and methods of the prior art some of the advantages thereof, while simultaneously overcoming some of the disadvantages normally associated therewith.

Still another object of the present invention is to provide a new safety light for indicating the current location of a child, snowmobile rider, hunter, or the like.

Even still another object of the present invention is to provide a new safety light that includes a housing having a front face, a rear face, and a periphery formed therebetween defining an interior space. The rear face having a recess formed therein. A pin and clasp assembly is coupled within the recess of the housing and adapted to releasably attach the housing to a first recipient surface. A pile type fastener is adhered to the rear face of the housing and surrounds the rectangular recess. The pile type fastener is adapted to releasably attach the housing to a second recipient surface. Also included is a light emitting diode connected to the housing and adapted to illuminate upon the receipt of power. Finally, a switch is connected between the light emitting diode and a battery for allowing the transmission of power to the light emitting diode upon the closing thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
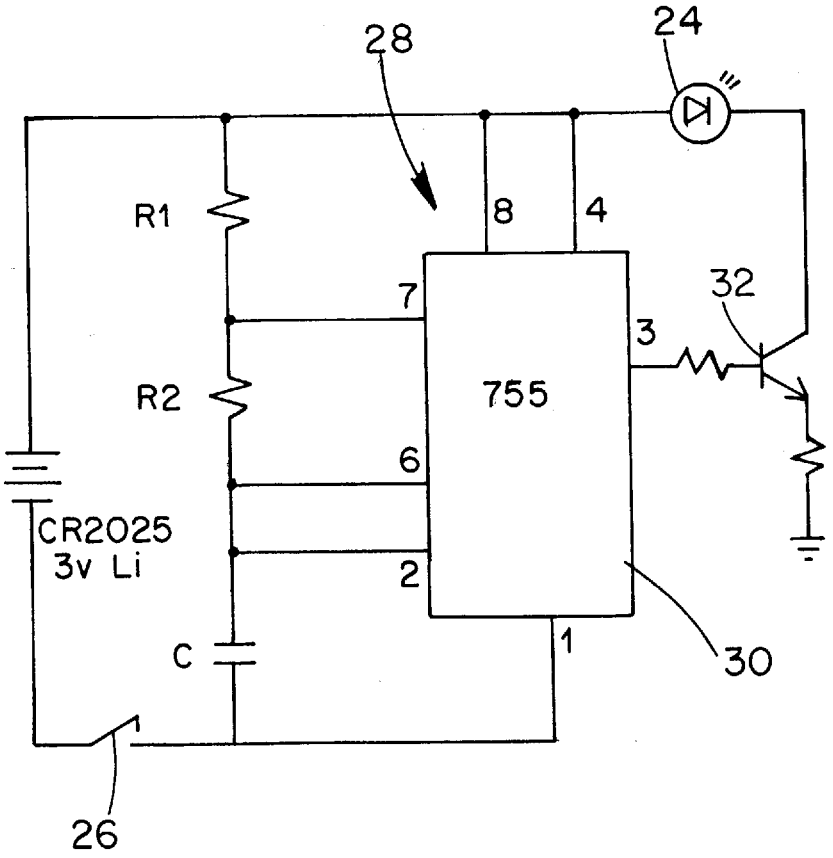
FIG. 1 is a schematic diagram of a new safety light according to the present invention.
Figure 2:
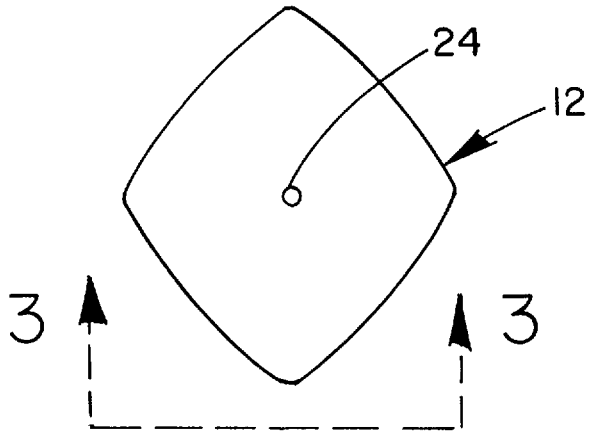
FIG. 2 is a front view of the housing of the present invention.

With reference now to the drawings, and in particular to FIGS. 1 through 5*b* thereof, a new safety light embodying the principles and concepts of the present invention and generally designated by the reference numeral 10 will be described.

Figure 4A:
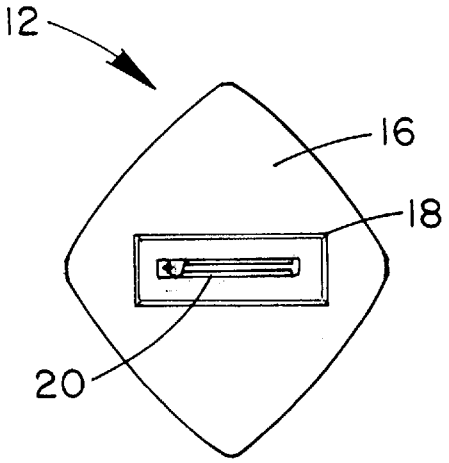
FIG. 4*a* is a rear view of the housing of the present invention depicting the pin and clasp assembly.

The present invention includes a diamond-shaped housing 12 with a generally rectilinear configuration having a translucent front face 14, an opaque rear face 16, and a periphery formed therebetween defining an interior space. As shown in FIG. 4*a*, the rear face has a rectangular recess 18 formed therein. The front face of the housing is tinted a yellow color. In the preferred embodiment, the front and rear faces of the housing have a first diagonal of about 1.5 inches and a second diagonal of about 1.75 inches.

With continuing reference to FIG. 4*a*, a pin and clasp assembly 20 is coupled within the recess of the housing. The pin of the assembly is adapted for pivoting between a stored orientation with the pin residing within a plane defined by the rear face of the housing and an extended orientation with the pin residing within a plane residing in perpendicular relationship with the rear face of the housing and extending outwardly from the recess. The pin and clasp assembly is adapted to releasably attach the housing to a first recipient surface such as an area of cloth. Such is accomplished by removing the pin from the clasp, attaching the pin to the recipient surface, and subsequently engaging the pin with the clasp.

Figure 4B:
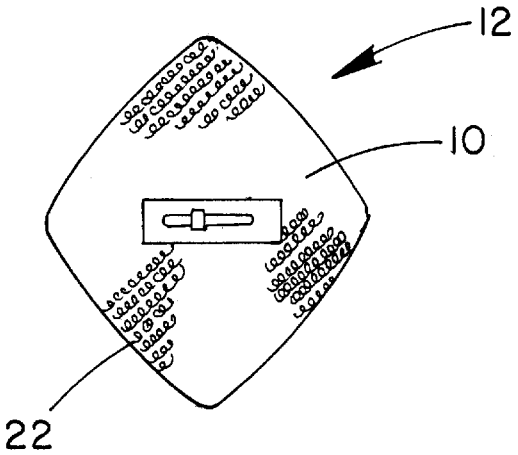
FIG. 4*b* is another rear view of the housing of the present invention depicting the pile type fastener.
Figure 5A:
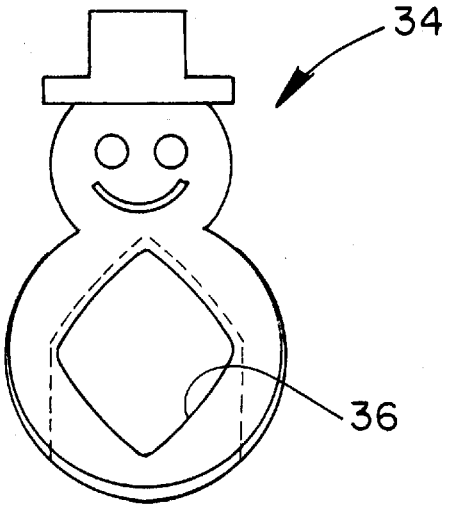
FIG. 5*a* is a front view of one of the figures of the present invention.
Figure 5B:
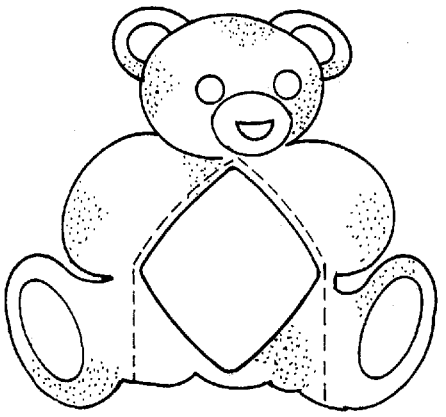
FIG. 5*b* is a front view of another one of the figures of the present invention.

With reference now to FIG. 4*b*, a pile type fastener 22 is adhered to the rear face of the housing and surrounds the rectangular recess. The pile type fastener serves to releasably attach the housing to a second recipient surface such a complimentary pile type fastener. As shown in FIG. 4*b*, both the pin and clasp assembly and the pile-type fastener reside on the rear face in the preferred embodiment, as set forth hereinabove. The employment of the recess allows both of such coupling means to be utilized.

Figure 3:
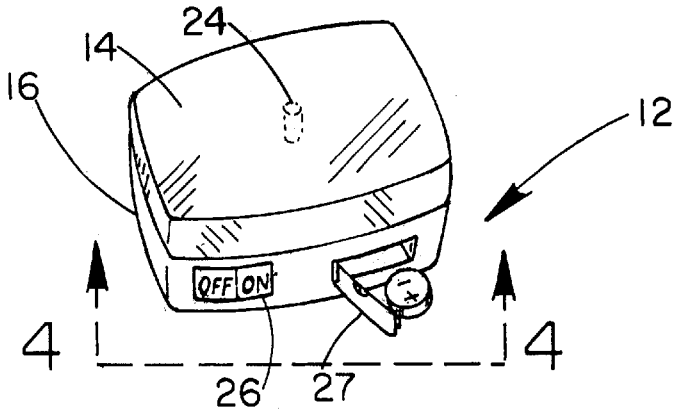
FIG. 3 is a perspective view of the housing of the present invention.

As shown in FIGS. 1 & 3, a light emitting diode 24 is provided. Such diode is situated within the interior space of the housing adjacent the front face thereof. In use, the light emitting diode functions to illuminate upon the receipt of power. Associated therewith is a toggle switch 26 situated on the periphery of the housing and connected between the light emitting diode and a battery. The switch allows the transmission of power to the light emitting diode only upon the manual closing thereof. Access to the battery is preferably gained via a hinged door 27 located either on the top or bottom face of the housing.

FIG. 1 shows a flashing means 28 situated within the interior space of the housing and connected between the switch and the light emitting diode. Upon the receipt of power, the flashing means effects the intermittent transfer of such power from the battery to the light emitting diode thereby effecting the flashing of light. Such is accomplished by way of a 755 timer 30 with an RC network including capacitor C and resistors R1 & R2 configured such that the timer functions as an astable multivibrator which consumes only small amounts of power. A transistor 32 is preferably employed to drive the illumination of the light emitting diode.

Finally, a plurality of FIGS. 34 are provided. Note FIGS. 5*a* & 5*b*. Each figure includes a rectilinear cut out 36 formed therein for removably receiving the housing such that the front face is visible and the rear face is accessible. As such, either of the coupling means may be utilized to attach the housing and figure to an article of clothing. While not shown, the housing and figures may employ locking tabs and recesses to maintain their relative orientation when being used. In the alternative, merely a frictional relationship may be employed.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A safety light comprising, in combination:

a diamond-shaped housing with a generally rectilinear configuration having a translucent front face, an opaque rear face, and a periphery formed therebetween defining an interior space, the rear face having a rectangular recess formed therein, the front face being tinted a yellow color, wherein the housing has a first diagonal of 1.5 inches and a second diagonal of about 1.75 inches;

a pin and clasp assembly including a pin swivably coupled within the recess of the housing for pivoting between a stored orientation with the pin residing within a plane defined by the rear face of the housing and an extended orientation with the pin residing within a plane residing in perpendicular relationship with the rear face of the housing and extending outwardly from the recess, the pin and clasp assembly adapted to releasably attach the housing to a first recipient surface;

a pile type fastener adhered to the rear face of the housing and surrounding the rectangular recess, the pile type fastener adapted to releasably attach the housing to a second recipient surface;

a light emitting diode situated within the interior space of the housing adjacent the front face thereof, the light emitting diode adapted to illuminate upon a receipt of power;

a toggle switch situated on the periphery of the housing and connected between the light emitting diode and a battery for allowing the transmission of power to the light emitting diode upon the manual closing of the toggle switch, wherein a hinged door selectively precludes access to the battery;

flashing means situated within the interior space of the housing and connected between the switch and the light emitting diode for effecting the intermittent transfer of power upon the receipt thereof from the battery thereby effecting the flashing of the light emitting diode; and a plurality of figures each including a rectilinear cut out formed therein for removably receiving the housing such that the front face is visible and the rear face is accessible.

2. A safety light comprising:

a housing having a front face, a rear face, and a periphery formed therebetween defining an interior space, the rear face having a recess formed therein;

a pin and clasp assembly including a pin swivably coupled within the recess of the housing for pivoting between a stored orientation with the pin residing within a plane defined by the rear face of the housing and an extended orientation with the pin residing within a plane residing in perpendicular relationship with the rear face of the housing and extending outwardly from the recess, the pin and clasp assembly adapted to releasably attach the housing to a first recipient surface;

a pile type fastener adhered to the rear face of the housing and surrounding the rectangular recess, the pile type fastener adapted to releasably attach the housing to a second recipient surface;

a light connected to the housing and adapted to illuminate upon a receipt of power;

a switch situated on the housing and connected between the light and a battery for allowing the transmission of power to the light upon the closing thereof; and at least one figure including a cut out formed therein for removably receiving the housing such that the light is visible and the rear face is accessible.

3. A safety light as set forth in claim 2 and further including flashing means situated within the interior space of the housing and connected between the switch and the light for effecting the intermittent transfer of power upon the receipt thereof from the battery thereby effecting the flashing of the light.

4. A safety light as set forth in claim 2 wherein the front face of the housing is translucent and tinted a yellow color, wherein the light is situated within the housing.

* * * * *